US005083847A

United States Patent [19]

Peters

[11] Patent Number: 5,083,847

[45] Date of Patent: Jan. 28, 1992

[54] POCKET DOOR ATTACHMENT FITTING FOR A CABINET

[75] Inventor: Chris R. Peters, Chico, Calif.

[73] Assignee: Transfer Flow International, Inc., Chico, Calif.

[21] Appl. No.: 646,847

[22] Filed: Jan. 28, 1991

[51] Int. Cl.[5] ..... A47B 88/00

[52] U.S. Cl. ..... 312/322

[58] Field of Search ..... 312/322, 323, 138.1; 16/235, 236, 237; 49/404, 407, 482

[56] References Cited

U.S. PATENT DOCUMENTS

| | | | |
|---|---|---|---|
| 429,857 | 8/1892 | Tettelbach | 312/323 X |
| 1,678,453 | 7/1928 | Welch | 312/307 X |
| 1,900,493 | 3/1933 | Friedrichs | 312/323 |
| 2,615,194 | 10/1952 | Kreiner | 16/237 X |
| 3,206,794 | 9/1965 | Johnson | 16/237 |
| 4,124,262 | 11/1978 | Schill | 312/307 X |
| 4,279,454 | 7/1981 | Koiso | 312/307 X |
| 4,554,706 | 11/1985 | Roch et al. | 16/237 |
| 4,800,625 | 1/1989 | Salice | 16/237 |

*Primary Examiner*—Joseph Falk

[57] ABSTRACT

A rigid, elongated bracket formed substantially 90 degrees to conform to the shape of an edge corner of a door panel. The elongated bracket has two permanently affixed and spaced apart rigid posts on a top surface thereof, and apertures to receive mounting screws on a side surface thereof. One surface of the bracket rests on an end edge of a cabinet door, with the posts extending outward into an L-shaped guide track attached to a cabinet. A side surface of the bracket extends over a portion of the back side of the door, and screws or other suitable fasteners are applied through the apertures of the bracket into the back surface of the door to retain the bracket in place. One 90 degree bracket with posts inserted into an L-shaped guide track is used at one end of the door, and a second 90 degree bracket with posts inserted into a second L-shaped guide track is used at the oppositely disposed end of the door. The guide track is additionally structured with a flange which provides a bearing surface which the bracket slides against in use.

2 Claims, 4 Drawing Sheets

POCKET DOOR ATTACHMENT FITTING FOR A CABINET

BACKGROUND OF THE INVENTION

1. Field of the Invention:

The invention of this disclosure generally relates to attachment hardware useful for supporting a door of a cabinet. More precisely, this invention relates to improved pocket door attachment fittings providing affixed support posts which slide in a recessed guide track to allow the slidable opening and closing of the door of a cabinet.

2. Description of the Prior Art:

Slidable pocket doors typically do not have traditional pivotal hinges, but instead generally utilize posts or wheels affixed to the edges of the door, and riding in guide tracks. This system of posts or wheels in combination with guide tracks allows the door to be slidably retracted into an interior space, such as the interior of a cabinet where the door parallels the sidewall of the cabinet, leaving generally only the thin edge of the door showing through the open front of the cabinet. Pocket doors are employed where it is desirable to generally conceal the doors when in the open position, such as with display cases, stereo cabinets, and kitchen countertop appliance garages for example, where a certain aesthetic appearance may be desired. Pocket or retractable doors also conserve space directly in front of the cabinet, which may be useful in areas where space is limited. Furthermore, post and guide track door mounting hardware may be completely concealed with the door in the closed position, making for a more attractive overall cabinet.

Retractable pocket doors mounted in wooden cabinets which utilize posts have traditionally used four posts, two posts affixed to one edge of the door, and two posts affixed to the oppositely disposed edge of the door. The posts slide in recessed guide tracks, one guide track on each interior side of the cabinet adjacent each set of posts. Guide track generally consists of an open U-shaped channel formed into an L-shaped track member. Guide tracks are normally recessed into the floor and ceiling of a cabinet, or the two oppositely disposed sidewalls of a cabinet, positioned with one leg of the L-shaped track to the front of the cabinet, and the remaining portion of the L-shaped track extending toward the rear of the cabinet.

The majority of the past art pocket door support posts have been affixed to the door panels as separate units, each post being recessed into a separately drilled hole on the edge of the door. The independent affixment of the posts has several major disadvantages, one being the weakening of the door panel in the specific area of the drilled aperture. Cabinet door panels are generally quite thin, normally being ½ to ¾ inches thick, and the drilling of a hole in the edge leaves a relatively thin layer of material on either side of the hole for supporting the post. This is especially significant when the door is manufactured of compressed chip board or plywood, sometimes leading to a fracture or failure of the wood on the side of the posts if stresses are applied to the door.

Another disadvantage of the individually affixed posts is that extreme care must be taken to precisely locate each post in relation to one another and also to the posts on the oppositely disposed edge of the door panel, otherwise binding of the door may occur during operation. A significant amount of time is also required to measure, drill and affix individual posts in this manner, which adds significantly to manufacturing costs even if templates or jigs are used for marking the holes to be drilled. A further disadvantage of individually installed posts is that the door cannot be easily removed or disconnected without causing major damage to the cabinet, since the posts are typically not accessible or removable once the entire cabinet is assembled.

A past art patent search was conducted at the U.S. Patent and Trademark Office to examine door attachment fittings similar to my invention. Of those patents examined, the following are considered most relevant:

J. M. Lewis et al were granted U.S. Pat. No. 4,727,680, on Mar. 1, 1988, for "Door Assembly For Cabinets Or The Like". The Lewis device concerns a door assembly for a "floppy disc" drive unit of a computer. This door assembly uses stationary posts affixed to the door panel which are guided within channels in the computer housing. Although not specifically illustrated, the stationary posts appear to be inherent to the plastic door panel itself. Incorporating the posts inherently into the door panel conserves time in assembly, but this method is not practical when used with wood. Wooden door panels having inherent wooden posts would not be strong enough, especially if constructed of particle board, and the manufacturing time of each door panel would be substantially increased. Furthermore, wooden doors are not plastic injection molded as is most likely the case with the Lewis device.

Another pertinent patent was issued to H. V. Steuernagel on Oct. 27, 1914, U.S. Pat. No. 1,115,345 for a "Swinging Structure Mount". Steuernagel discloses a structure with posts which are housed within grooves incorporated into the supporting body, providing an upward opening door. The posts of Steuernagel's device are apparently individually installed into the door panel. As previously stated, individual posts provide a relatively weak support structure in wood, and further require a great deal of time to install, which can be a major consideration in large scale assembly-line cabinetry construction where speed is crucial to keeping the cost of manufacturing low.

Other patents examined which were not directly relevant to my invention in that they utilized pivotal wheels or rollers instead of stationary posts, included U. S. Pat. Nos. 1,008,266, 1,223,697, 4,089,135, and a British patent, number 374,798. Rollers and wheels used in pocket door mountings generally take a greater amount of space for efficient operation than do stationary posts, and therefore are generally not suitable for wooden cabinetry where space is limited. Furthermore, roller and wheel assemblies are relatively costly to manufacture, and often need replacement due to wear of the moving parts every few years, otherwise binding and jamming will occur in the door during operation. Additionally, upward facing U-shaped guide tracks often collect dirt in the bottom interior, and since wheels or rollers roll directly on the bottom surface of the track, and they can not push the dirt out of the upward facing U of the track, collected dirt can adversely effect the operation of the wheels or rollers.

BRIEF SUMMARY OF THE INVENTION

My invention, which solves many of the past art problems, comprises an elongated rigid angle support bracket having two right cylindrical guide posts permanently affixed stationary to one exterior surface of the bracket. The bracket will usually be bent or formed as an elongated 90 degree bracket since this will fit a 90 degree corner of a door panel. The posts are spaced apart from one another, and each are spaced the same distance from the lengthwise side edge or corner of the bracket. The side of the bracket, opposite to that which is affixed with the guide posts, contains apertures for attachment of the bracket to a door with screws or other suitable fasteners. The posts affixed to the bracket are sized for fitting into, and sliding within a guide track affixed within a groove in the interior of a cabinet.

When installing a single pocket door which opens laterally, the top and bottom edges of one side edge of the door are each affixed with my guide post bracket. Two of my guide tracks are recessed into the interior surface of the cabinet, one guide track on the ceiling with the other recessed into the floor of the cabinet directly beneath the first. The front leg of the guide track extends parallel to the front edge of the cabinet with the other or side leg positioned parallel to a sidewall and extending toward the rear of the cabinet.

When opening a laterally movable door, pressure is exerted by hand on the front side edge of the door, with the brackets being affixed basically behind the area being pressed. One guide post within the top track, and one guide post within the bottom track is forced backward within the side leg of the guide track parallel to the sidewall, while the other guide posts ride in the front leg portion of the guide tracks and slide toward the corner of the L-shaped track. Continued pushing pivots the door approximately 90 degrees. When the door is parallel to the sidewall and extending straight outward in front of the cabinet, the second guide posts at the top and at the bottom are aligned with the side leg of the guide tracks. The door can then be pushed back into the cabinet into a stored position parallel and adjacent to the sidewall of the cabinet. With the door in the stored position, that is with the cabinet open, the 90 degree brackets are positioned adjacent the back interior corner of the cabinet, and all posts are in the side legs of the guide tracks.

One major advantage of affixing the guide posts onto a bracket is that all measuring is eliminated for location of post apertures, since the guide post bracket is always affixed to the rear corner of the door panel, generally regardless of the size of the door. The edge of the bracket is aligned with the edge of the corner of the door, and measurements are therefore not required. The time and expense of drilling guide post holes into the edge of the door for individual posts is also eliminated. If a large number of cabinets are being manufactured at one time, the application of the guide post brackets can significantly decrease assembly time since measurements and drilling are eliminated. Furthermore, a 90 degree bracket is easily positioned and held stationary with one hand, leaving the other hand free to apply screws with a screw gun to secure the bracket in place.

Since the posts are inherently affixed to the bracket, and a guide track is provided, this type of mounting arrangement increases the durability and strength of the structure, since the posts are not anchored in the softer wood of the door, and the posts are positioned to slide against the durable surfaces of the guide track rather than against wood. A large portion of cabinetry and furniture manufactured today utilizes plywood and particle board panels which are not well suited for supporting the individual guide posts. With the posts being well secured to the bracket, any stress exerted against the posts is extended over the entire bracket.

Another advantage of my invention is provided by the guide track in its preferred structure, which is made of smooth, slightly flexible and somewhat slick thermoplastic material. The guide tracks are partially recessed into grooves made into the interior surfaces of the cabinet, with the open side of the U-shaped groove of the track exposed. Flanged edges of the guide tracks extend above the interior surfaces of the cabinet, with the extending flanges of the guide tracks providing a slick bearing surface for which the smooth hard surface of the 90 degree bracket rides on during operation of the cabinet door. This provides smooth sliding operation of the door, and further maintains the door slightly away from the cabinet panels, thus preventing scratching of the interior of the cabinet and reducing problems which can occur from small amounts of dirt in the path of the sliding door. The guide posts are maintained off of the bottom surface of the guide track, and a small amount of dirt in the bottom of the track generally does not effect the smooth sliding action of the door.

Additionally, the flange of my guide track extends outward, covering or hiding the little imperfections such as small chips sometimes left in the cabinet panels by the cutting or router bit used to form the groove for receiving the track, thereby improving the interior appearance of the cabinet.

Therefore, a major object of this invention is to provide improved pocket door attachment fittings for supporting a cabinet pocket door, with the fittings structured so as to eliminate the need for measuring and of drilling individual guide post receiving apertures in the edge of the door.

A further object of the invention is to provide the above in pocket door attachment fittings which provide increased overall structural strength in supporting a door.

Another object of the invention is to provide the above in pocket door attachment fittings which allow easy removal and replacement of the door after installation of the door in a finished cabinet, this being for repair or refinishing ease.

An even further object of the invention is to provide the above in pocket door attachment fittings which when supporting a door allows the door in the closed position to be flush with the cabinet front facing, and further with the pocket door attachment fittings to be concealed.

An even further object of the invention is to provide the above in pocket door attachment fittings which can be manufactured inexpensively, and installed quickly and accurately with a low degree of skill.

BEST MODE OF CARRYING OUT THE INVENTION

Figure 1:
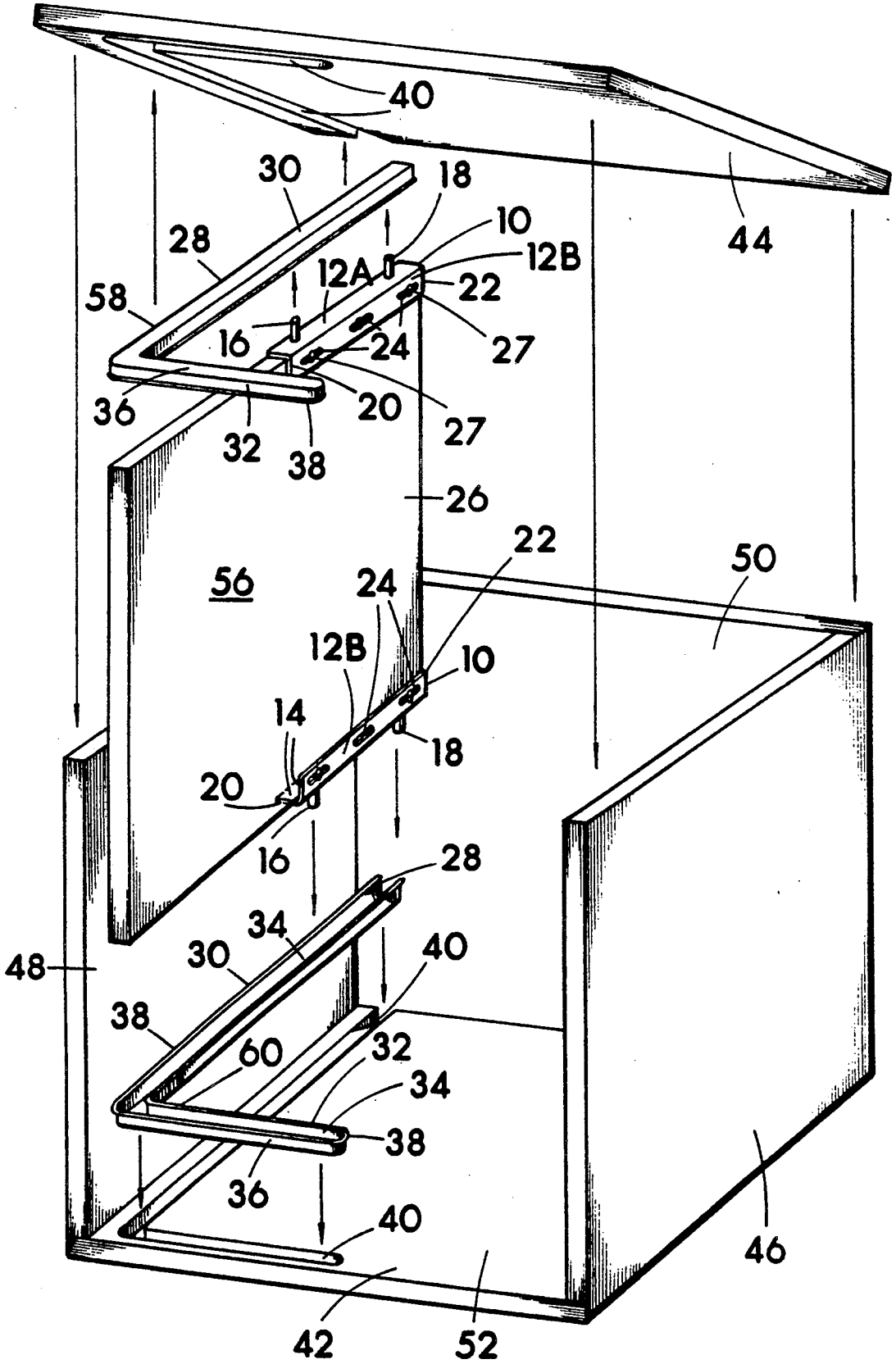
FIG. 1 is a partially exploded view of a single door cabinet which uses my pocket door attachment fittings.

Referring now to the drawings in general. FIG. 1 shows my elongated, substantially right angle bracket 10 having two exterior lengthwise surfaces 12 A and 12 B, and two interior lengthwise surfaces 14. Surfaces 14 are the oppositely disposed sides of surfaces 12 A and 12 B. Two brackets 10 are shown attached to a door 26 of a cabinet 46 in the partially exploded view of FIG. 1. Bracket 10 is preferably made of steel, but could be made of any suitably strong and substantially material such as aluminum, pot metal, and many plastics for example. Although bracket 10 is shown and described as bent or formed 90 degrees, this is only because the back side corners of cabinet doors 26 are usually square or 90 degrees, however, bracket 10 should be generally structured to substantially conform to the door corner to which bracket 10 is to be attached. In other words, if the door corner is rounded, then bracket 10 should be similarly shaped for a tight fit and substantial surface area contact between surfaces 14 with the edge corner of door 26 for added strength, stability, and ease of attachment.

Affixed to surface 12 A of bracket 10 are two substantially rigid right cylindrical posts, designated guide posts 16 and 18. Guide posts 16 and 18 are preferably made of the same material as that of bracket 10. Bracket 10 and guide posts 16 and 18 may be cast or molded as a single unit, or may be manufactured as separate pieces to be attached together by suitable attachment methods according to the material of manufacture, such as welding, sonic welding, adhesive bonding or other suitable methods.

Bracket 10 has a first end 20 and an oppositely disposed second end 22, with guide post 16 affixed toward end 20 and guide post 18 affixed toward end 22, but set in a short distance from end 22. Guide posts 16 and 18 are each spaced the same distance from the lengthwise side edge or corner of bracket 10, or in other words, guide posts 16 and 18 are attached to bracket 10 so that if a single straight line or axis were drawn through the centers of a pair of posts 16 and 18, the line would parallel the corner edge or length of bracket 10, and therefore parallel the back edge of door 26.

Surface 12 B of bracket 10 contains three elongated attachment apertures 24 to allow for releasable attachment of bracket 10 onto door 26 with screws 27. The elongated shape of attachment apertures 24 allows a certain degree of lateral adjustability of the positioning of bracket 10 during installation. The number and shape of apertures 24 could of course be varied.

Figure 5:
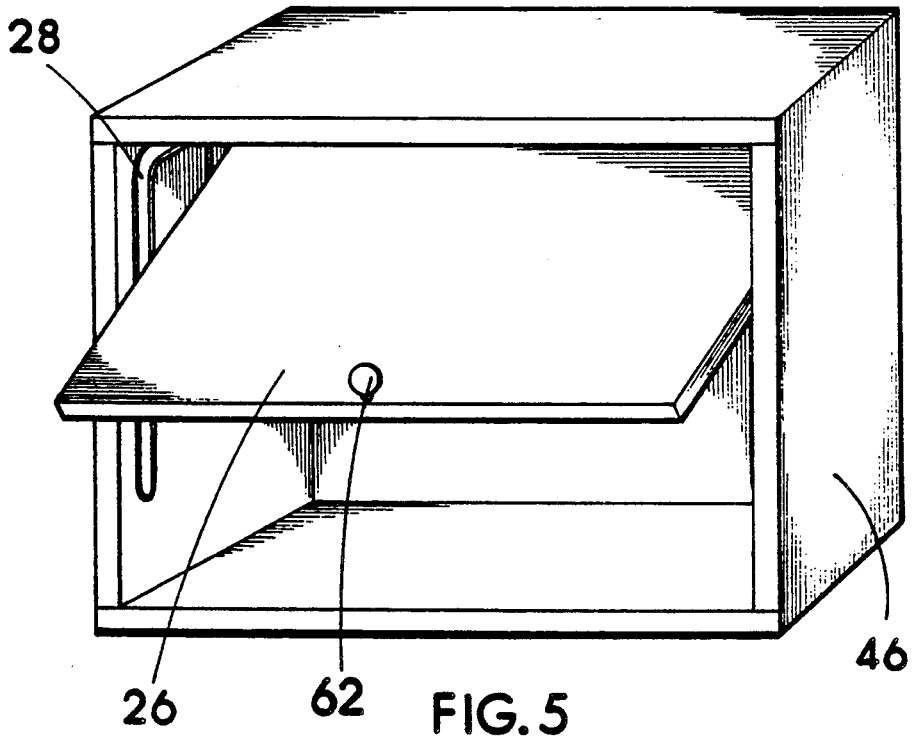
FIG. 5 is a perspective view of a cabinet which utilizes a single pocket door supported by my pocket door attachment fittings. The pocket door of this particular cabinet operate by way of vertical sliding, although it the identical structure to that shown in an FIG. 1 and 2.
Figure 6:
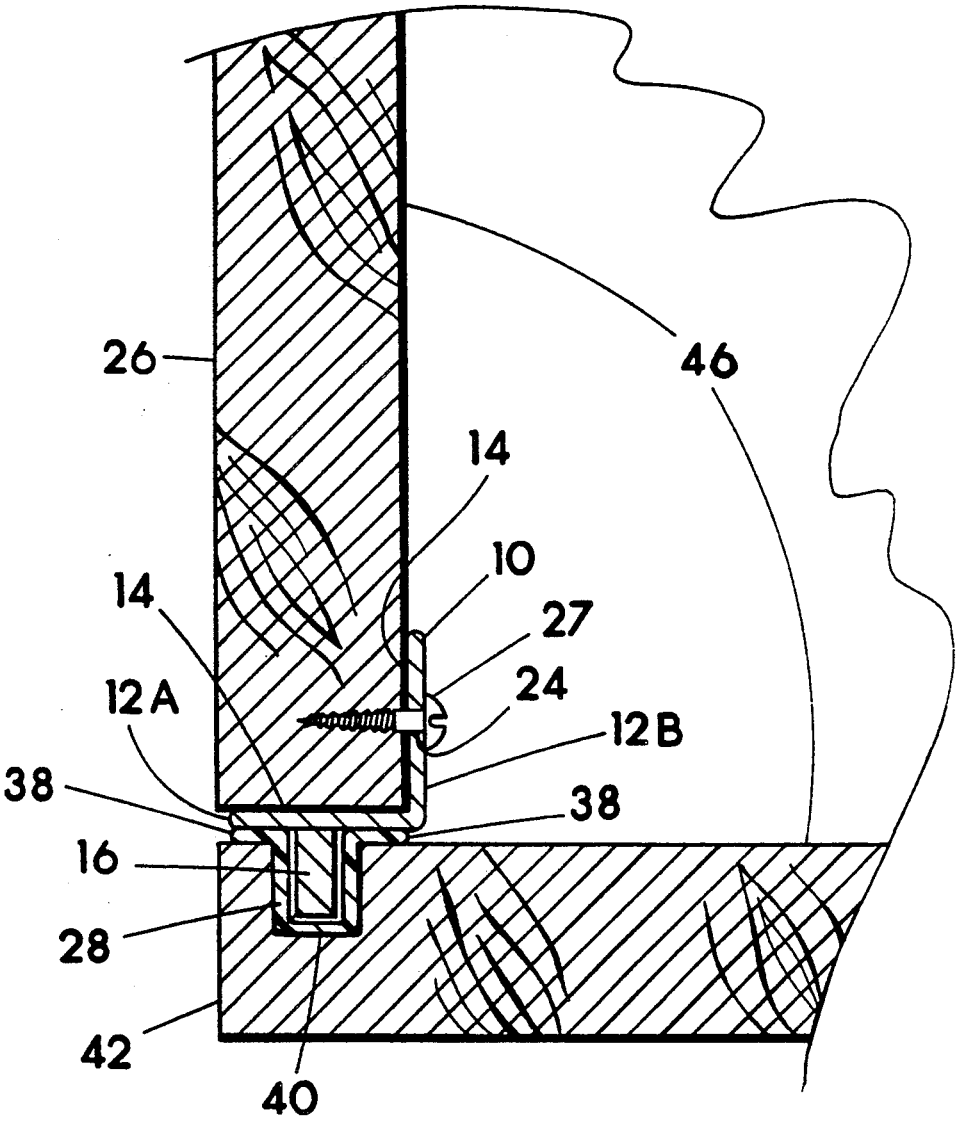
FIG. 6 is a view taken along line 6—6 of FIG. 4 illustrating the bracket with attached posts riding on the overhanging flange of the guide track rather than the panel of the cabinet.

Guide track 28 is comprised of a U-shaped channel, that is U-shaped in cross section, and formed roughly into an L-shaped track best shown in FIG. 1, and in cross section in FIG. 6. Guide track 28 may be made of metal or plastic, and should have smooth surfaces in the areas where the side surfaces of guide posts 16 and 18, and surface 12 A of bracket 10 may ride against while the door is being opened or closed, as may be ascertained from FIG. 6. The longer leg of guide track 28 is referred to as side leg 30 with the remaining shorter section referred to as front leg 32. The terminal end of guide track 28 adjacent front leg 32 terminates in a closed rounded end primarily for appearance reasons, while the terminal end of side leg 30 may be left as an open end. Guide track 28 has an interior surface 34 and an exterior surface 36, both with a relatively flat bottom and substantially vertical sidewalls. The upper free edges of the sidewalls of guide track 28 forms an exterior projecting overhang or flange 38 to provide a bearing surface for surface 12 A of bracket 10 as may be ascertained from FIG. 1 and 6, and further to cover the edges of groove 40. Exterior surface 36 of guide track 28 is sized for an interference fit into a groove 40 formed into the floor 42 and ceiling 44 of cabinet 46 as is the case in FIG. 1, or into the side panels of cabinet 46 as is the case of FIG. 5. The interference fit of guide track 28 into groove 40 allows the track 28 to be snapped into groove 40 and retained in place by frictional pressure, although adhesive glues may also be used if desired for added security. Guide tracks 28 are provided in mirror imaged sets, or some might say a left and right hand version as shown in FIG. 1, where an upper guide track 58 and a lower guide track 60 illustrate a mirror imaged set of guide tracks 28. When installed, the open ends of guide tracks 28 may abut the interior surface of back panel 50 of cabinet 46, thereby closing the open end of the track 28.

Grooves 40 are preferably created in the cabinet panels before assembly of cabinet 46. Groove 40 may be formed utilizing common material removal methods such as routing bits. The portion of groove 40 which receives side leg 30 of guide track 28 is formed parallel to the adjacent sidewall of cabinet 46, with the lengthwise center line of side leg 30 being a distance from the interior surface of the adjacent sidewall of cabinet 46 substantially equal to the distance of the center of guide post 18 to end 22 of bracket 10. This may be better understood by examining drawing FIGS. 1, 2, and 3, where in FIG. 2 side leg 30 is shown paralleling sidewall 48, and post 18 is in leg 30. In FIG. 3, door 26 is closed. In the closed position, post 18 would be in the corner of guide track 28, and aligned with side leg 30, with the side edge of door 26 closely adjacent sidewall 48 of cabinet 46. A small amount of clearance should be left between the side edge of door 26 and sidewall 48 to prevent interference when door 26 is being opened or closed as may be ascertained from FIG. 2.

Cabinet 46 of FIG. 1 is generally structured rectangular in shape, having vertical sidewalls 48 and back panel 50, with horizontal floor 42 and ceiling 44. The interior space of cabinet 46 is accessed through front opening 52. The portion of groove 40 housing side leg 30 of guide track 28 is positioned adjacent and parallel to sidewall 48 of cabinet 46, and the remaining section of groove 40 housing front leg 32 is positioned adjacent and parallel to front opening 52. Two identical brackets 10 and two guide tracks 28 are used for mounting the single door 26. The set of guide tracks 28 are not identical units, being mirror images of one another, as shown in FIG. 1. In assembly as may be ascertained from FIG. 1, one bracket 10 is attached to the upper outer right hand edge of the back surface 56 of door 26, with a second bracket 10 attached to the lower right hand edge directly beneath the first bracket 10. The surfaces 14 of both brackets 10 abut the back surface 56 and horizontal edges of door 26, as shown in FIG. 1. Surface 12 B with attachment apertures 24 of both brackets 10 are positioned against back surface 56 of door 26 with guide posts 16 and 18 positioned vertically. End 22 of each bracket 10 is aligned flush with the side edge of the door 26, again as may be ascertained from FIG. 1. Attachment apertures 24 are used to secure brackets 10 with a variety of attachment methods including screws 27, nails, adhesives, or even nuts and bolts.

To install door 26 with affixed brackets 10 in a partially disassembled cabinet 46 as shown in FIG. 1, door 26 is positioned with front surface 54 positioned adjacent and parallel to the left sidewall 48 of cabinet 46. Door 26 is then lowered, inserting guide posts 16 and 18 of the lower bracket 10 into lower guide track 60. The top panel or ceiling 44 is then lowered and affixed into position on the top edges of sidewalls 48 and back panel 50, while directing guide posts 16 and 18 into upper guide track 58 of ceiling 44. Guide posts 16 and 18 of both the upper and lower brackets 10 are now slidably housed within side leg 30 of upper guide track 58 and lower guide track 60, respectfully.

Connection of door 26 can also be made after the complete assembly of cabinet 46. Both guide posts 16 and 18 of each un-affixed bracket 10 are positioned within side leg 30 of their respective guide tracks 28, with the upper bracket 10 requiring temporary manual support to prevent falling out. Door 26 is aligned with front surface 54 parallel to sidewall 48 of cabinet 46, directly over side leg 30. Door 26 is then positioned by way of a sliding movement against surfaces 14 of the upper and lower brackets 10, and then secured in proper position relative to brackets 10 with screws 27. The reverse of this installation procedure is very useful for removal and replacement of door 26 for repairs or refinishing at a later date.

The procedure for closing door 26 when door 26 is retracted into the cabinet 46 of FIG. 1, is to pull the front edge of door 26 forward until both upper and lower guide posts 16 abut the corner of the respective guide tracks 58 and 60. Door 26 partially projects outward from front opening 52 at this point. The front or outer edge of door 26 is then pushed over to the right which directs guide post 16 into front leg 32 of guide tracks 28 while simultaneously pulling guide post 18 forward within side legs 30 of the guide tracks. When the upper and lower guide posts 18 abut the corners of both guide tracks 58 and 60, door 26 will be in the closed position, as shown in FIG. 3. Door 26 in the closed position is prevented from being moved further into the cabinet due to the abutment of posts 16 and 18 against the interior sides of front legs 32 of track 28. Door 26 in the stored or open position is prevented from being pushed too far back into cabinet 46 by the abutment of the back edge of door 26 against back panel 50, although the back edge of door 26 or post 18 abutting a stop block of some kind could be used if desired to prevent door 26 from moving rearward into cabinet 46 beyond a given point.

Figure 2:
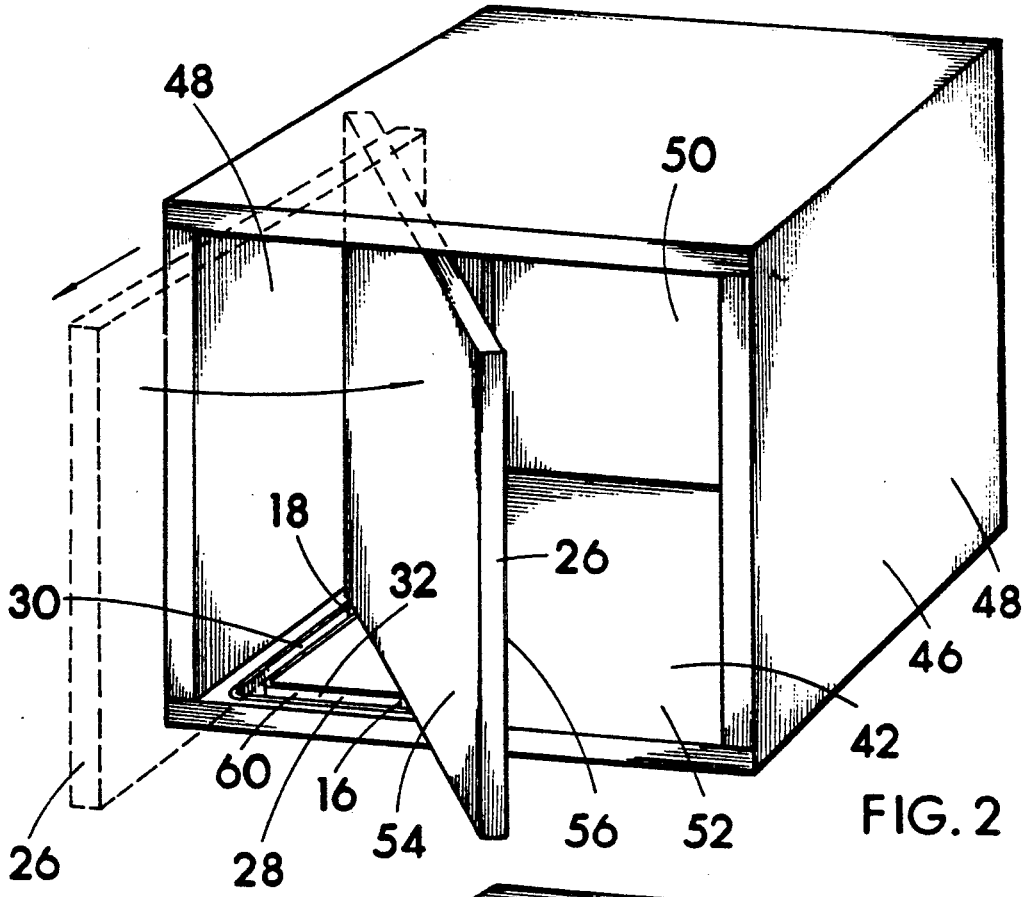
FIG. 2 is a perspective view of the assembled cabinet of FIG. 1 is the pivotal positioning of the door in the closing procedure.
Figure 3:
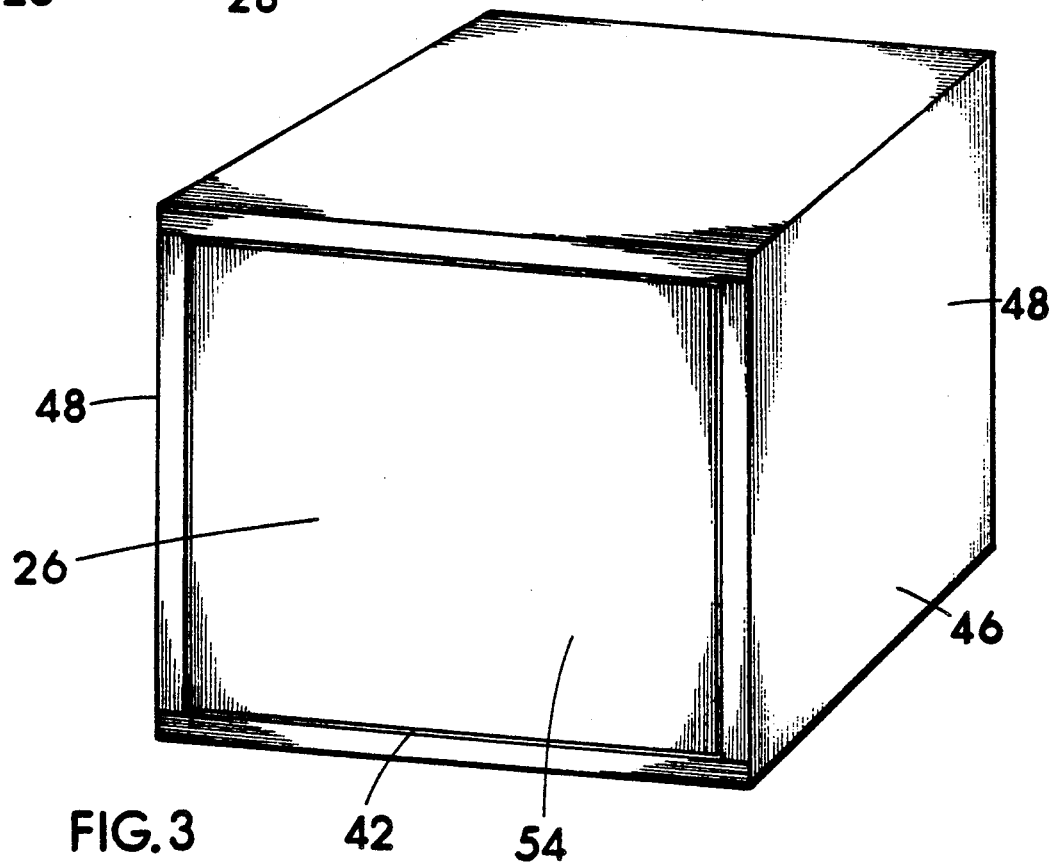
FIG. 3 is a perspective view of the cabinet of FIG. 1 and 2 showing the door in the closed position flush with the cabinet facing and the pocket door attachment fittings concealed from view.
Figure 4:
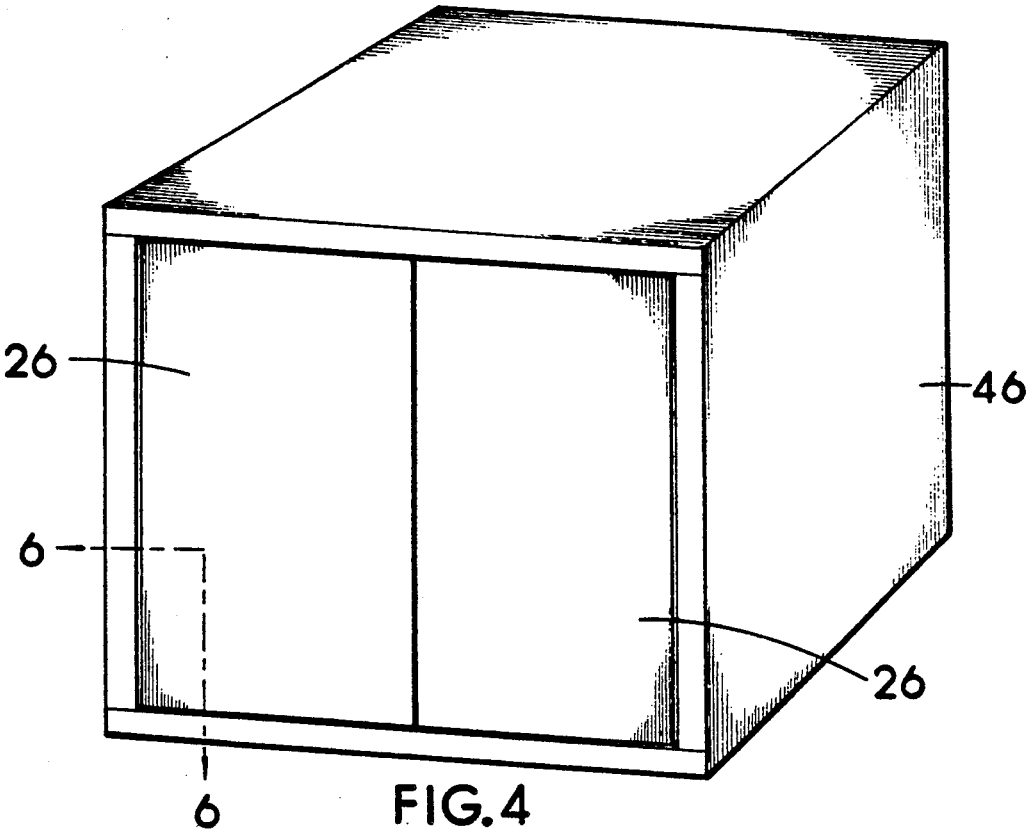
FIG. 4 is a perspective view of a cabinet which utilizes two pocket doors which are supported by my pocket door attachment fittings. The second door of a two door cabinet would be essentially attached in the same manner and with an set of mounting fittings as that shown in FIG. 1.

Although a single laterally openable door 26 as shown in FIG. 1 and 2 has been principally described using my pocket door attachment fittings, vertically openable doors 26 as shown in FIG. 5 can also be accommodated with my invention by recessing guide tracks 28 into the interior sidewalls 48 of cabinet 46, and by affixing brackets 10 on the upper vertical corners of door 26. Lateral opening double doors 26 as shown in FIG. 4 can also be installed using two sets of brackets 10 and guide tracks 28. The second door 26 of a two door cabinet would be essentially attached in the same manner as that described above for a single door 26.

Additionally, a handle 62 could be attached to door 26 as shown in FIG. 5 if it were desired to not have to press or grasp directly against door 26 to open and close it. This would be particularly desirable for glass doors where finger prints are easily left. When using a handle 62, door 26 as shown in FIG. 5 should be mounted close to the outer edge of door 26, that is the oppositely disposed side edge from brackets 10 in order to allow door 26 to be moved into the open position. In this situation door 26 may be moved into a stored or open position to the point where handle 62 abuts the outer edge of cabinet 46, leaving a short portion of the edge of door 26 extending slightly out of cabinet 46.

It should be understood that the scope of this invention should not be limited by the specification and drawings herein given for example, but should be determined by the broadest possible interpretation of my appended claims.

What I claim as my invention is:

1. A pocket door attachment fitting useful in sets of two substantially identical pocket door attachment fittings used in conjunction with a left-hand-L-shaped guide track and a right-hand L-shaped guide track mounted oppositely disposed from one another within the interior of a cabinet, said pocket door attachment fittings for slidably and removably attaching a pocket door to the cabinet, a single said pocket door attachment fitting comprising;

an elongated substantially rigid bracket formed of a first side and a second side affixed substantially perpendicular to one another so as to conform to a corner of a pocket door defined by an intersection of a back surface and an adjacent edge surface of the pocket door;

at least two elongated apertures through said first side of said bracket with said elongated apertures in said apart relationship to one another, said elongated apertures providing means to allow attachment of said bracket to a pocket door by threaded fasteners passed through said elongated apertures and into the back surface of the pocket door with said first side of said bracket placed against the back surface of the pocket door and said second side of said bracket placed against the adjacent edge intersecting the back surface of the pocket door, said elongated apertures being elongated so as to provide means for a substantial degree of lateral adjustability in placement of said bracket during the attachment of said bracket to the pocket door with the threaded fasteners;

said bracket further including two substantially rigid posts each affixed to an exterior surface of said second side of said bracket, said posts being in spaced apart relationship to one another with one said post placed toward a first end of said bracket and the other said post placed toward a second end of said bracket, said posts each extending outward in substantially the same direction away from said exterior surface of said second side of said bracket so as to allow placement of both said posts within a single L-shaped guide track attached to the cabinet, said bracket being absent a third side oppositely disposed from said first side of said bracket so as to render said bracket substantially concealed from view when said bracket is supporting a pocket door with the pocket door in a closed position over an access opening of the cabinet.

2. A combination of a generally rectangular cabinet having an access opening and a door slidably and removably affixed to said cabinet to provide an openable closing means for said access opening of said cabinet;

said door slidably affixed to said cabinet with pocket door attachment fittings which include an elongated substantially rigid first bracket formed of a first side and a second side affixed substantially perpendicular to one another so as to conform to a first rear corner of said door, said first bracket affixed over said first rear corner of said door by threaded fasteners passed through elongated apertures in said first side of said first bracket and into a back surface of said door, said first bracket further including two substantially rigid posts affixed to an exterior surface of said second side of said first bracket, said posts being in spaced apart relationship to one another with one said post placed toward a first end of said first bracket and the other said post placed toward a second end of said first bracket, said posts each extending outward i substantially the same direction from said first bracket and into a right-hand-L-shaped guide track, said right-hand-L-shaped guide track fabricated of plastic and affixed substantially recessed within a first L-shaped groove in a first panel exposed within the interior of said cabinet, said posts sized to allow sliding thereof within said right-hand L-shaped guide track, said right-hand L-shaped guide track having at least one flange member extending beyond said first L-shaped groove, said flange member providing a smooth bearing surface on which said exterior surface of said second side of said first bracket slidably abuts and thereby said first bracket inclusive of said door affixed thereto is maintained a distance away from said first panel of said cabinet, the maintaining of said first bracket and said door a distance away from said first panel further maintaining said posts a distance away from an interior bottom surface of said right-hand L-shaped guide track;

said pocket door attachment fittings further including an elongated substantially rigid second bracket formed of a first side and a second side affixed substantially perpendicular to one another so as to conform to a second rear corner of said door, said second bracket affixed over said second rear corner of said door by threaded fasteners passed through elongated apertures in said first side of said second bracket and into said back surface of said door, said second bracket further including two substantially rigid posts affixed to an exterior surface of said second side of said second bracket, said posts of said second bracket being in spaced apart relationship to one another with one said post placed toward a first end of said second bracket and the other said post placed toward a second end of said second bracket, said posts of said second bracket each extending outward in substantially the same direction from said second bracket and into a left-hand L-shaped guide track, said left-hand L-shaped guide track fabricated of plastic and affixed substantially recessed within a second L-shaped groove in a second panel exposed within the interior of said cabinet, said posts of said second bracket sized to allow sliding thereof within said left-hand L-shaped guide track, said left-hand L-shaped guide track having at least one flange member extending beyond said second L-shaped groove, said flange member of said left-hand L-shaped guide track providing a smooth bearing surface on which said exterior surface of said second side of said second bracket slidably abuts and thereby said second bracket inclusive of said door affixed thereto is maintained a distance away from said second panel, the maintaining of said second bracket and said door a distance away from said second panel further maintaining said posts of said second bracket a distance away from an interior bottom surface of said left-hand-L-shaped guide track;

said right-hand and left-hand L-shaped guide tracks being affixed oppositely disposed from one another within the interior of said cabinet with said posts of said first bracket slidably placed within said right-hand L-shaped guide track and said posts of said second bracket slidably placed within said left-hand L-shaped guide track with said door affixed to said first and second brackets by way of said threaded fasteners providing means for allowing said door to be slidably positioned into a stored position generally within said cabinet and substantially parallel and adjacent to a third panel of said cabinet spanning between said first and second panels of the cabinet, and further providing means for allowing said door to be slidably positioned into a closed position over said access opening of said cabinet;

said first bracket and said second bracket each being absent a third side oppositely disposed from said first sides of said brackets so as to render both said first and second brackets substantially concealed from view with said door in a closed position over said access opening of said cabinet.

* * * * *